US008061039B2

(12) United States Patent
Kwiecien et al.

(10) Patent No.: US 8,061,039 B2
(45) Date of Patent: Nov. 22, 2011

(54) SHAVING CARTRIDGES HAVING ELONGATED SKIN CONTACTING MEMBERS

(75) Inventors: Michael Joseph Kwiecien, Scituate, MA (US); Alejandro Carlos Lee, Cambridge, MA (US)

(73) Assignee: The Gillette Company, Boston, MA (US)

( * ) Notice: Subject to any disclaimer, the term of this patent is extended or adjusted under 35 U.S.C. 154(b) by 305 days.

(21) Appl. No.: 12/468,147

(22) Filed: May 19, 2009

(65) Prior Publication Data

US 2010/0293789 A1 Nov. 25, 2010

(51) Int. Cl.
*B26B 21/44* (2006.01)

(52) U.S. Cl. ..... 30/41; 30/50

(58) Field of Classification Search ..... 30/41, 50
See application file for complete search history.

(56) References Cited

U.S. PATENT DOCUMENTS

| | | | | |
|---|---|---|---|---|
| 4,586,255 | A * | 5/1986 | Jacobson | 30/41 |
| 4,624,051 | A | 11/1986 | Apprille, Jr. et al. | |
| 4,683,096 | A | 7/1987 | Ferraro | |
| 4,692,986 | A * | 9/1987 | Motta et al. | 29/451 |
| 4,697,342 | A | 10/1987 | Ferraro | |
| 4,875,287 | A | 10/1989 | Creasy et al. | |
| 5,056,221 | A | 10/1991 | Thoene | |
| 5,056,222 | A | 10/1991 | Miller et al. | |
| 5,063,667 | A * | 11/1991 | Jacobson | 30/41 |
| 5,249,361 | A | 10/1993 | Apprille, Jr. et al. | |
| 5,416,973 | A | 5/1995 | Brown et al. | |
| 5,430,939 | A | 7/1995 | Johnston | |
| 5,493,778 | A * | 2/1996 | Ichiyanagi | 30/41 |
| 5,551,153 | A | 9/1996 | Simms | |
| 5,557,851 | A | 9/1996 | Ortiz | |
| 6,115,902 | A * | 9/2000 | Garland et al. | 29/417 |
| 6,138,361 | A * | 10/2000 | Richard et al. | 30/50 |
| D447,283 | S | 8/2001 | Tseng et al. | |

(Continued)

FOREIGN PATENT DOCUMENTS

EP 0 254 490 A1 1/1988

(Continued)

OTHER PUBLICATIONS

PCT International Search Report with Written Opinion in corresponding Int'l appln. PCT/US2010/035171 dated Jul. 22, 2010.

*Primary Examiner* — Hwei C Payer
(74) *Attorney, Agent, or Firm* — John M. Lipchitz; Kevin C. Johnson; Steven C. Miller

(57) ABSTRACT

A razor cartridge which has a housing with a pocket defined by a front wall and a rear wall. The pocket has a seat surface and at least one of the front and rear walls include one or more flexible segments. One or more blades are mounted within the housing. An elongated skin contacting member is provided that comprises a shaving aid composite that has one or more water-leachable shaving aid materials. The elongated skin contacting member has a body portion with an upper skin contacting surface and a base portion which is disposed at least partially within the pocket. The base portion has a bottom surface spaced apart from the seat surface. The base portion extends laterally outwardly from the body portion and is in mechanical engagement with the one or more flexible segments to secure the skin contacting member to the housing.

18 Claims, 6 Drawing Sheets

U.S. PATENT DOCUMENTS

| | | | | |
|---|---|---|---|---|
| 6,301,785 | B1 * | 10/2001 | Kwiecien et al. | 30/41 |
| D456,563 | S | 4/2002 | Kwiecien et al. | |
| D611,199 | S * | 3/2010 | Kwiecien et al. | D28/47 |
| 7,802,353 | B2 * | 9/2010 | Gratsias et al. | 29/524.1 |
| 2002/0066186 | A1 * | 6/2002 | White et al. | 30/50 |
| 2002/0095791 | A1 * | 7/2002 | Pennella et al. | 30/50 |
| 2004/0139611 | A1 | 7/2004 | Vreeland | |
| 2006/0254056 | A1 * | 11/2006 | Coffin et al. | 30/41 |
| 2011/0099815 | A1 * | 5/2011 | Burgio et al. | 30/41 |

FOREIGN PATENT DOCUMENTS

| | | |
|---|---|---|
| EP | 0 287 387 | 10/1988 |

* cited by examiner

SHAVING CARTRIDGES HAVING ELONGATED SKIN CONTACTING MEMBERS

FIELD OF THE INVENTION

The present invention relates to shaving razors and more particularly to shaving razor cartridges having a housing and an elongated skin contacting member secured to the housing.

BACKGROUND OF THE INVENTION

In general, shaving razors of the wet shave type include a cartridge or blade unit with at least one blade with a cutting edge which is moved across the surface of the skin being shaved by means of a handle to which the cartridge is attached. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled. Razor cartridges usually include a guard which contacts the skin in front of the blade(s) and a cap for contacting the skin behind the blade(s) during shaving. The cap and guard aid in establishing the so-called "shaving geometry", i.e., the parameters which determine the blade orientation and position relative to the skin during shaving, which in turn have a strong influence on the shaving performance and efficacy of the razor. The guard may be generally rigid, for example formed integrally with a frame or platform structure which provides a support for the blades.

In the use of shaving razors of the wet shave type, factors such as frictional drag of the razor across the skin, force needed to sever hairs, and irritation or pre-existing skin damage can create a degree of shaving discomfort. Shaving aids, e.g., a lubricant, whisker softener, razor cleanser, medicinal agent, cosmetic agent or combination thereof, have been incorporated into razors, for example by incorporating a shaving aid into one or more extruded or molded polymeric components of the razor. Such shaving aid composites may be mounted on the cap or guard structures of the razor cartridge. Upon exposure to water, water-soluble shaving aid leaches from the composite onto the skin and the composite tends to swell.

The shaving aid composites must be positively secured for effective dispensing throughout the useful shaving life of the razor. Forces during shaving may contribute to loosening of the shaving aid components from the cartridge. Numerous extruded or molded shaving aid components have been developed which are secured to the shaving razor cartridge with adhesives. These arrangements have been unsatisfactory for certain applications. Adhesives are typically a poor choice for several reasons. Adhesives are difficult to work with from a manufacturing perspective and are also susceptible to changes in heat and humidity. In certain countries, shaving razors are exposed to constant high levels of heat and humidity during shipment and storage. These levels of heat and humidity can adversely affect the adhesive properties such that the lubrication component is no longer secured. Various press-fit type designs have also been developed to secure the shaving aid component to the cartridge of the shaving razor. The various press-fit type designs have also proven to be ineffective in certain applications. Press-fit designs rely on a significant amount of force to be applied to the shaving aid composite in order to properly secure the shaving aid composite within the housing, which may cause the shaving aid composite to break or fracture. These designs are also not very effective because they do not accommodate for changing forces resulting from the shaving aid composite swelling and expanding. These cartridge designs also rely on an increased surface contact area with the shaving aid composite to better secure the shaving aid composite to the cartridge, which limits the cartridge design, such as the size of the cartridge and the placement of the blade(s).

SUMMARY OF THE INVENTION

In one aspect, the invention features, in general, a housing including a front wall and a rear wall which together define a pocket having a seat surface, wherein at least one of the front and rear walls include one or more flexible segments. One or more blades positioned below the seat surface. An elongated skin contacting member is provided that comprises a shaving aid composite that has one or more water-leachable shaving aid materials. The elongated skin contacting member has a body portion with an upper skin contacting surface and a base portion disposed at least partially within the pocket. The base portion has a bottom surface that is spaced apart from the seat surface, wherein the base portion extends laterally outwardly from the body portion and is in mechanical engagement with the one or more flexible segments to secure the elongated skin contacting member to the housing.

In another aspect, the invention features, in general, a shaving cartridge including a housing having a pocket defined by a front wall and a rear wall. One or more blades are mounted within the housing. An elongated skin contacting member is provided that has a width that is greater than its height. The elongated skin contacting member has a body portion with an upper skin contacting surface and a base portion disposed at least partially within the pocket. The base portion extends laterally outward from the body portion and is in mechanical engagement with at least one of the front and rear walls to secure the skin contacting member to the housing.

If, desired, particular embodiments may optionally include the elongated skin contacting member having a shaving aid composite with one or more water-leachable shaving aid materials. Particular embodiments may also optionally include the pocket having a seat surface that is spaced apart from the base portion to allow for swelling of the elongated skin contacting member. Particular embodiments may also optionally include a seat surface with a protrusion to provide support the elongated skin contacting member.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings.

DETAILED DESCRIPTION OF THE INVENTION

Figure 1:
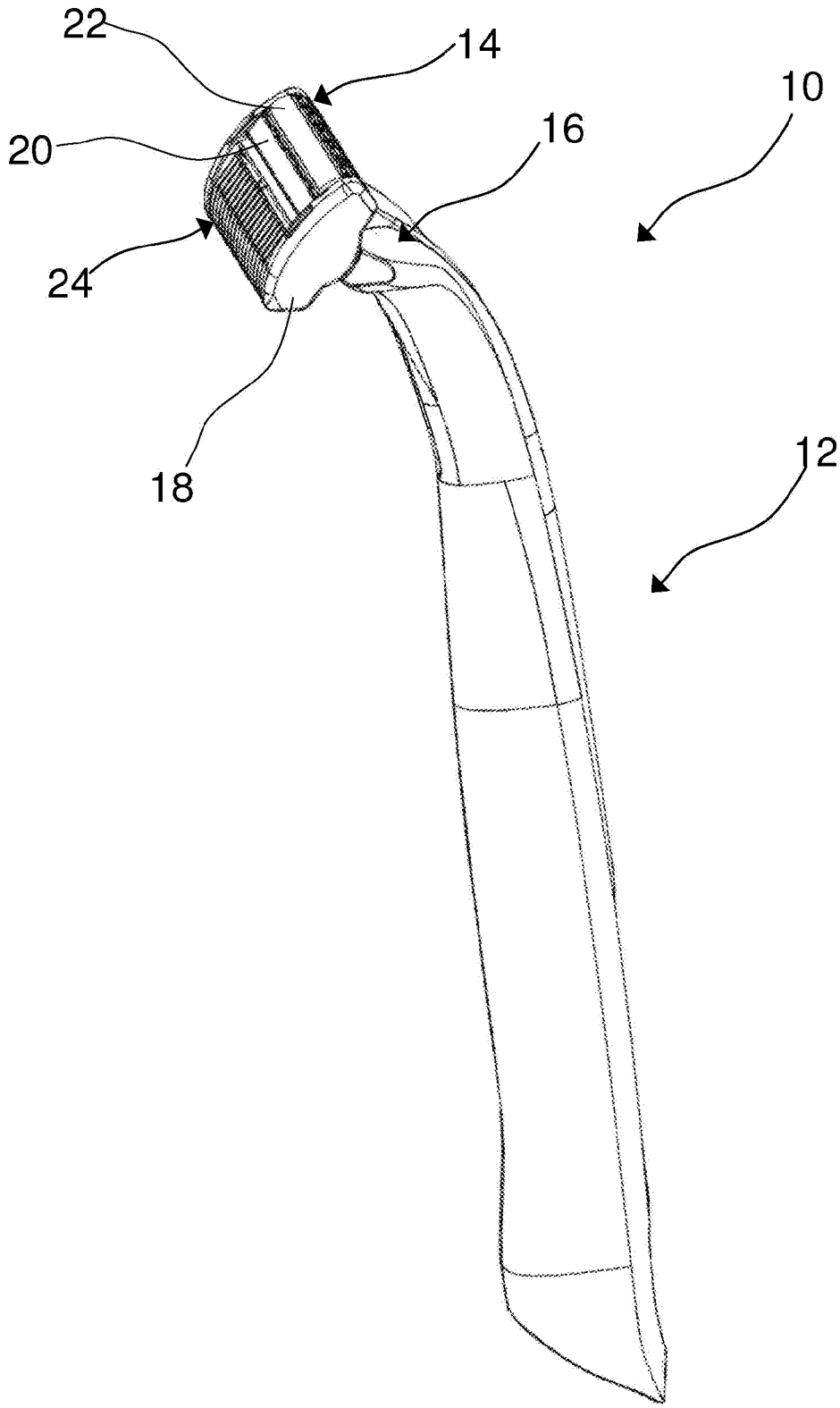
FIG. 1 is a perspective view of one possible embodiment of a shaving razor.

Referring to FIG. 1, one possible embodiment of the present disclosure is shown illustrating a shaving razor 10 having a handle 12 and a cartridge 14. In certain embodiments, the cartridge 14 may be detached and removed from the handle 12. The cartridge 14 may be fixedly or pivotably mounted to the handle 12. The handle 12 or cartridge 14 may also include an interconnect member 16 to which the cartridge 14 is pivotably mounted about a pivot axis. The cartridge 14 may include a housing 18 that carries one more blades 20, a guard member 24, and an elongated skin contacting member 22. The one or more blades 20 may be mounted within the housing 18 and secured with a clamp plate (not shown). Other assembly methods known to those skilled in the art may also be used to secure the one or more blades 20 to the housing 18 including, but not limited to wire wrapping, cold forming, hot staking, insert molding, and adhesives. The one or more blades may be positioned between the guard member 24 and the elongated skin contacting member 22. The guard member 24 and the elongated skin contacting member 22 may define a shaving plane.

In certain embodiments, the housing 18 may be molded from Noryl™ (a blend of polyphenylene oxide (PPO) and polystyrene developed by General Electric Plastics, now SABIC Innovative Plastics). The housing 18 may be molded from other semi-rigid polymers having a Shore A hardness of about 50, 60 or 70 to about 90, 110, or 120. The elongated skin contacting member 22 may be a separate molded or extruded component that is mounted to the housing 18. The elongated skin contacting member 22 may be molded or extruded from the same material as the housing 18 or may be molded or extruded from a more lubricious shaving aid composite that has one or more water-leachable shaving aid materials to provide increased comfort during shaving. The shaving aid composite may comprise a sheath of water-insoluble polymer that surrounds a core which includes a skin-lubricating water-soluble polymer.

Suitable water-insoluble polymers which may be used for the matrix (or sheath) include polyethylene, polypropylene, polystyrene, butadiene-styrene copolymer (e.g., medium and high impact polystyrene), polyacetal, acrylonitrile-butadiene-styrene copolymer, ethylene vinyl acetate copolymer and blends such as polypropylene/polystyrene blend, may have a high impact polystyrene (i.e., Polystyrene-butadiene), such as Nova HIPS 731G from Nova Chemicals.

Suitable skin lubricating water-soluble polymers may include polyethylene oxide, polyvinyl pyrrolidone, polyacrylamide, hydroxypropyl cellulose, polyvinyl imidazoline, and polyhydroxyethylmethacrylate. Other water-soluble polymers may include the polyethylene oxides generally known as POLYOX (available from Dow Chemical) or ALKOX (available from Meisei Chemical Works, Kyota, Japan). These polyethylene oxides may have molecular weights of about 100,000 to 6 million, for example, about 300,000 to 5 million. The polyethylene oxide may comprises a blend of about 40 to 80% of polyethylene oxide having an average molecular weight of about 5 million (e.g., POLYOX COAGULANT) and about 60 to 20% of polyethylene oxide having an average molecular weight of about 300,000 (e.g., POLYOX WSR-N-750). The polyethylene oxide blend may also contain up to about 10% by weight of a low molecular weight (i.e., MW<10,000) polyethylene glycol such as PEG-100.

The shaving aid composite may also optionally include an inclusion complex of a skin-soothing agent with a cylcodextrin, low molecular weight water-soluble release enhancing agents such as polyethylene glycol (e.g., 1-10% by weight), water-swellable release enhancing agents such as cross-linked polyacrylics (e.g., 2-7% by weight), colorants, antioxidants, preservatives, microbicidal agents, beard softeners, astringents, depilatories, medicinal agents, conditioning agents, moisturizers, cooling agents, etc.

The design of the cartridge 14 and the elongated skin contacting member 22 may facilitate easy removal and replacement of the elongated skin contacting member 22. Frequently, the blades 20 and the elongated skin contacting member 22 do not wear at the same rate. If the elongated skin contacting member 22 wears faster than the blades 20, the entire shaving razor 10 or cartridge 14 must be replaced prematurely. In certain embodiments, if the user is no longer satisfied with the performance of the shaving cartridge 14, due to perceived lack of lubricity, the elongated skin contacting member 22 may be easily removed and replaced. The replacement of the elongated skin contacting member 22 may be even more advantageous for double edge style shaving razors, which incorporate a replaceable razor blade, rather than replacing the entire cartridge and/or shaving razor.

Figure 2:
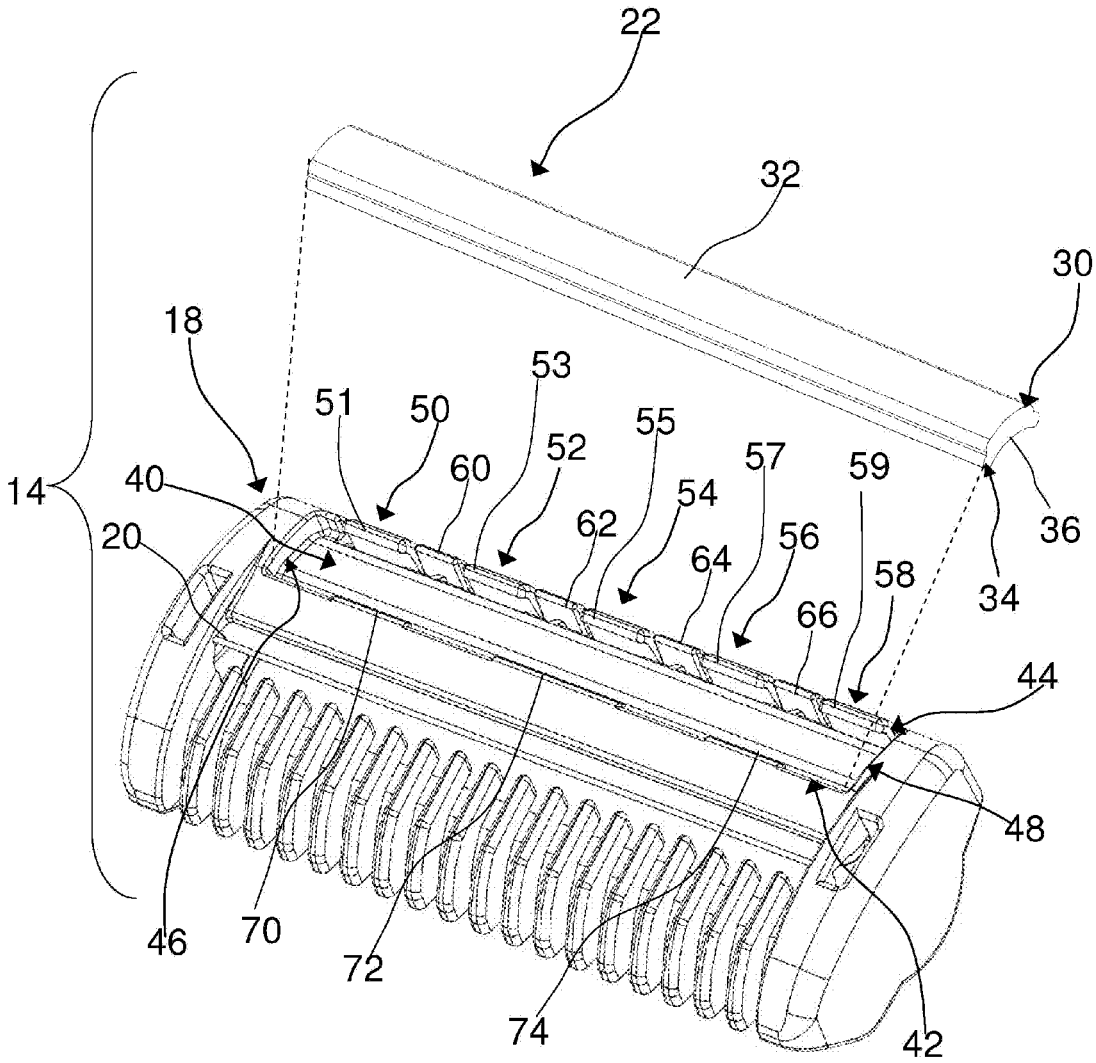
FIG. 2 is an assembly perspective view of one possible embodiment of a cartridge which may be incorporated into the shaving razor of FIG. 1.

Referring to FIG. 2, a perspective assembly view of the cartridge 14 is shown illustrating the assembly of the elongated skin contacting member 22 to the housing 18. The elongated skin contacting member 22 may have a generally rectangular shape, (e.g., its length is greater than its width). The shape of the elongated skin contacting member 22 may have a generally low profile to enable the elongated skin contacting member 22 to be mounted to a cartridge 14 having a low profile (e.g., smaller height). The elongated skin contacting member 22 may include a body portion 30 having an upper skin contacting surface 32, and a base portion 34 having a bottom surface 36. The upper skin contacting surface 32 may have a generally convex profile to provide a smooth, comfortable feel against the skin of the user. The upper skin contacting surface 32 may also aid in establishing the shaving plane. The base portion 34 may extend laterally outward from the body portion 30, such that a width of the base portion 34 is greater than a width of the body portion 30. The bottom surface 36 of the base portion 34 may have a generally arcuate profile (i.e., concave). The profile of the bottom surface 36 may reduce material costs by reducing unneeded shaving aid composite (which may be relatively expensive) and may also provide for a more uniform wall thickness, which may improve processing (i.e., extrusion or molding) efficiency.

The housing 18 may have a pocket 40 that is dimensioned to receive the elongated skin contacting member 22. The pocket 40 may be defined by a front wall 42 and a rear wall 44. The pocket 40 may also be defined by a pair of side walls 46 and 48. The side walls 46 and 48 may be spaced apart from the elongated skin contacting member 22 to improve the ease of assembly and allow for swelling and expansion of the elongated skin contacting member 22. The rear wall 44 may include one or more flexible segments 50, 52, 54, 56 and 58, each having a free end 51, 53, 55, 57, and 59. The flexible segments 50, 52, 54, 56 and 58 may include deflectable members, such as latches to facilitate securing the elongated skin contacting member 22 to the housing 18. The flexible segments 50, 52, 54, 56 and 58 may also deflect to accommodate swelling of the elongated skin contacting member 22 due to absorption of water. The rear wall 44 may include one or more retention segments 60, 62, 64, and 66 that are positioned between the flexible segments 50, 52, 54, 56 and 58. The retention segments 60, 62, 64, and 66 may be generally rigid to support the elongated skin contacting member 22 within the pocket 40 and prevent excess deflection of the flexible segments 50, 52, 54, 56 and 58, which may result in the elongated skin contacting member 22 disengaging from the housing 18. The flexible segments 50, 52, 54, 56, and 58 and the retention segments 60, 62, 64, and 66 may be spaced apart to allow for expansion of the elongated skin contacting member 22 in-between adjacent segments 50, 52, 54, 56, 58, 60, 62, 64, and 66. The spacing may minimize the force applied to the front and rear walls 42 and 44 as the elongated skin contacting member 22 swells and expands beyond its original shape. The front wall 42 may also have a plurality of spaced apart segments 70, 72, and 74. The plurality of spaced apart segments 70, 72, and 74 may include deflectable members or generally rigid retention members. The front and rear walls 42 and 44 may include any possible combination of retention segments 60, 62, 64, and 66 and flexible segments 50, 52, 54, 56, and 58 to secure the elongated skin contacting member 22 within the housing 18. The front and/or rear walls 42 and 44 may even include flexible segments 50, 52, 54, 56, and 58, but no retention segments 60, 62, 64, and 66. In certain embodiments, the housing 18 may include the front wall 42 that is generally solid and the rear wall 44 with a plurality of flexible segments 50, 52, 54, 56, and 58. Alternatively, the housing 18 may include the rear wall 44 that is generally solid and the front wall 42 with a plurality of flexible segments 50, 52, 54, 56, and 58.

The repetitive swelling and shrinking of the shaving aid component is an issue for typical cartridges because the shaving aid component has a tendency to loosen from the cartridge and eventually fall out. Unlike press-fit or press-in designs, the front and rear walls 42 and 44 of the housing 18 may allow for repetitive swelling and shrinking of the elongated skin contacting member 22 without the elongated skin contacting member 22 disengaging from the housing 18. Also, once assembled, the front and rear walls 42 and 44 of the housing 18 require very little force to maintain the elongated skin contacting member 22 secured. Due to the reduced forces applied to the elongated skin contacting member 22, the wall thickness and cross sectional profile of the elongated skin contacting member 22 may be reduced without risking damage to the elongated skin contacting element 22 during assembly or shaving. The reduced forces may also allow the skin contacting member 22 to have an increased number of possible formulations that could not have been used before because of concerns regarding the strength of the shaving aid composite used to manufacture the skin contacting member 22. For example, improved shaving aid composites with enhanced skin benefits may used for the skin contacting member 22 even if the improved shaving aid composite used is weaker than standard shaving aid composites.

Figure 3A:
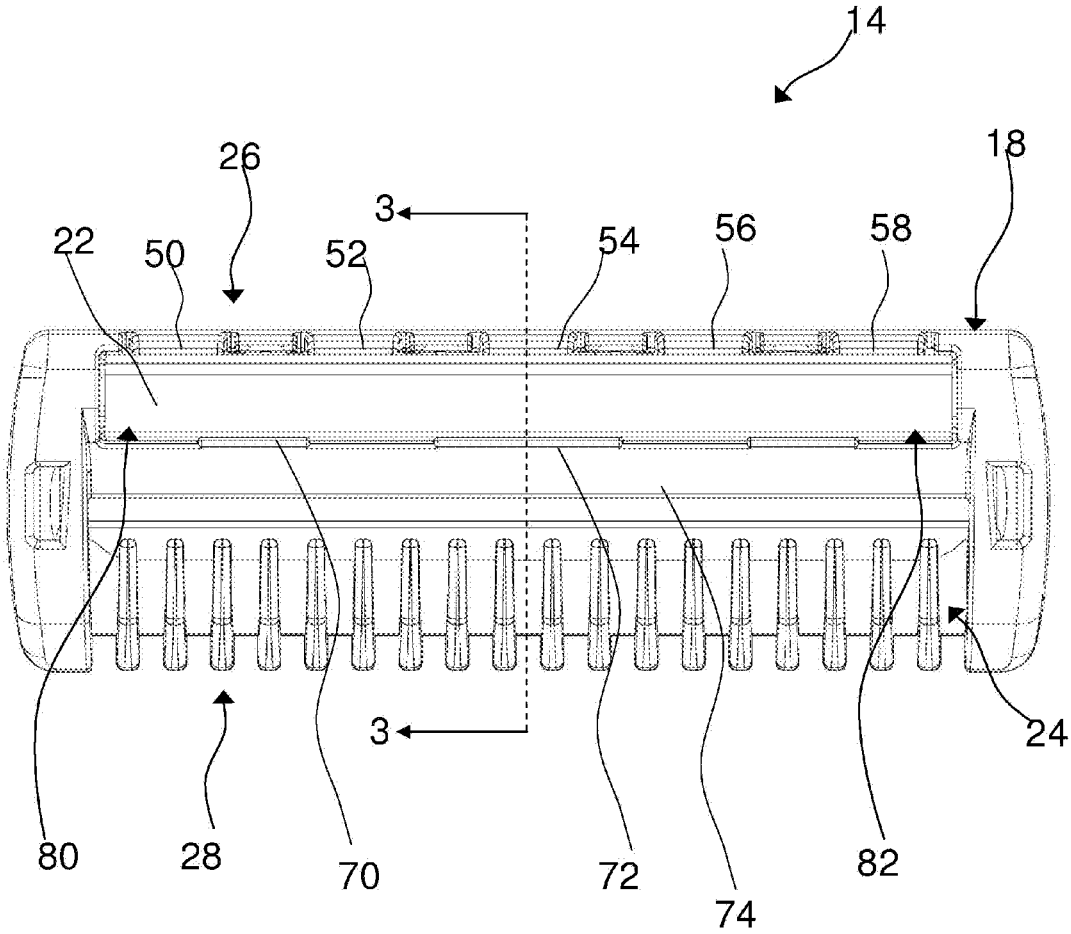
FIG. 3A is a top plan view of the cartridge of the cartridge of FIG. 2.

Referring to FIG. 3A, a top plan view the cartridge 14 is shown illustrating the elongated skin contacting member 22 assembled to the housing 18. Although the elongated skin contacting member 22 is illustrated as secured to the housing 18 at a distal end portion 26 of the housing 18, the elongated skin contacting member 22 may alternatively (or in addition to) be secured to a proximal end portion 28 of the housing 18 adjacent or within the guard member 24. The pocket 40 (not shown) may at least partially receive the elongated skin contacting member 22. One or more of the flexible segments 50, 52, 54, 56 and 58 on the rear wall 44 may overlap at least a portion of the elongated skin contacting member 22 to secure the elongated skin contacting member 22 to the housing 18. One or more of the flexible segments 50 and 58 may also be positioned at a first and second end portions 80 and 82 (respectively) of the elongated skin contacting member 22 to provide additional support and prevent disengagement of the elongated skin contacting member 22 from the housing 18.

Figure 3B:
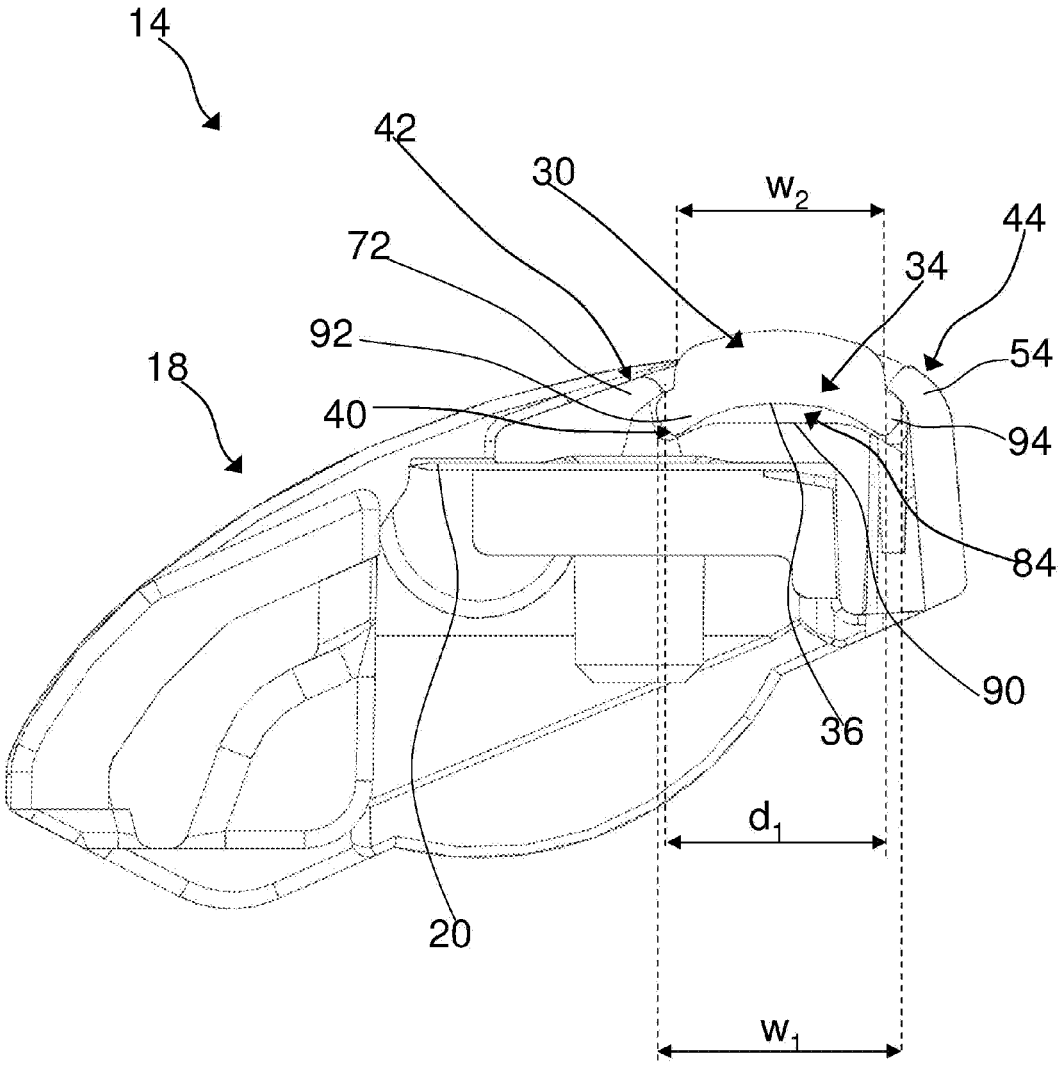
FIG. 3B is a cross section view of the cartridge, taken generally along the line 3-3 of FIG. 3A.

Now with additional reference to FIG. 3B, the attachment of the elongated skin contacting member 22 to the housing 18 will be explained in greater detail. FIG. 3B illustrates a cross section view of the cartridge 14, taken generally along the line 3-3 of FIG. 3A. The elongated skin contacting member 22 may be attached to the housing 18 such that the base portion 34 of the elongated skin contacting member 22 is at least partially disposed within the pocket 40. The pocket 40 may include a seat surface 90 that is generally flat. In certain embodiments, the bottom surface 36 of the base portion 34 may have a generally arcuate (i.e., concave) profile that is spaced apart from the seat surface 90, which may allow for swelling and expansion of the elongated skin contacting member 22 within the pocket 40. The elongated skin contacting member 22 may swell and increase in size during shaving, which may result in the elongated skin contacting member 22 disengaging from the housing 18. By providing a gap 84 between the seat surface 90 and the bottom surface 36, the elongated skin contacting member 22 may swell into the gap 84, which may prevent disengagement or expulsion of the elongated skin contacting member 22 from the housing 18. In certain embodiments, the bottom surface 36 may be spaced apart from the seat surface 90 by about 0.01 mm, 0.015 mm, or 0.02 mm to about 0.03 mm, 0.04 mm, or 0.05 mm. The seat surface 90 may support at least a portion of the base portion 34, for example, one or more lateral end portions 92 and 94 of the base portion 34 may contact the seat surface 90.

Although FIG. 3B illustrates the seat surface 90 as generally flat and the bottom surface 36 of the elongated skin contacting member 22 as generally concave, other embodiments are also possible to provide for an open space for the elongated skin contacting member 22 to swell and expand. For example, the bottom surface 36 of the elongated skin contacting member 22 may be generally flat and the seat surface 90 may be generally concave or have recesses to provide for an open space for the elongated skin contacting member 22 to swell and expand.

The base portion 34 may have a width "$w_1$" that is greater than a distance "$d_1$" between the front wall 42 and the rear wall 44. For example, $w_1$ may be greater than $d_1$ by about 3%, 5%, or 7% to about 10%, 15%, or 20%. In certain embodiments, $d_1$ may be about 1 mm, 2 mm, or 3 mm to about 3.5 mm, 4 mm or 4.5 mm. The base portion 34 may be dimensioned to fit securely between the front wall 42 and the rear wall 44 of the housing 18. In certain embodiments, $w_1$ may be about 1.5 mm, 2.5 mm, or 3.5 mm to about 4.5 mm, 5 mm or 5.5 mm. The body portion 30 may have a width "$w_2$" that is less than "$w_1$". In certain embodiments, $w_2$ may be about 1 mm, 2 mm, or 3 mm to about 4 mm, 4.5 mm or 5 mm. As the base portion 34 is inserted into the pocket 40, one or more of the flexible segments 54 of the rear wall 44 may deflect to accommodate the larger width of the base portion 34. Once the base portion 34 is properly secured within the pocket 40, one or more of the flexible segments 54 may deflect back to its original position resulting in an audible feedback, such as a snap or a click sound. The audible feedback is useful during assembly to signal the person operating or managing the assembly process that the elongated skin contacting member 22 is properly secured to the housing 18. The base portion 34 may be in mechanical engagement with one or more of the flexible segments 54 of the rear wall 44 and one or more of the segments 72 of the front wall 42, such that one or more of the flexible segments 54 and one or more of the segments 72 overlap at least a portion of the base portion 34 (i.e., lateral end portions 92 and 94), thus preventing disengagement or expulsion of the elongated skin contacting member 22 from the housing 18. In certain embodiments, the body portion 30 may not be in mechanical engagement or contacting the rear wall 44 or the front wall 42. The base portion 30 not contacting the rear wall 44 or the front wall 42 may allow for improved contact with the skin for an enhanced tactile feel.

The elongated skin contacting member 22 may have a relatively small wall thickness to reduce costs, or may be comprised of a weaker material in order to achieve certain shaving benefits, such as increased skin lubrication. The mounting or attachment of the elongated skin contacting member 22 to the housing 18 requires less force than other mechanical assembly methods. For example, press-fit designs may break or damage the elongated skin contacting member 22 during attachment because of the increased force needed for proper assembly and the reduced strength of the elongated skin contacting member 22.

Figure 4:
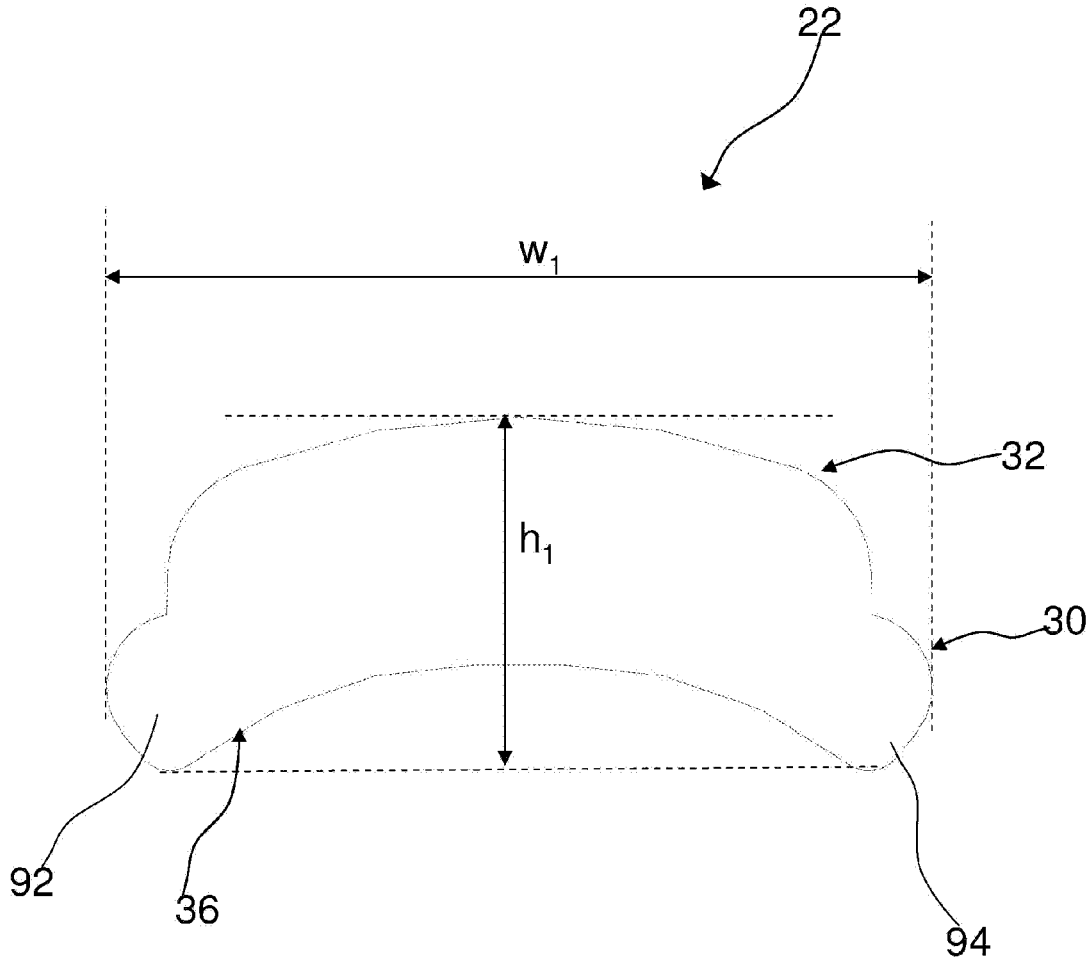
FIG. 4 is a cross section view of one possible embodiment of an elongated skin contacting member which may be incorporated into the cartridge of FIG. 3A.

Referring to FIG. 4, a cross section view of the elongated skin contacting member 22 is illustrated. The elongated skin contacting member 22 may allow for the cartridge 14 (not shown) to have a lower profile. The elongated skin contacting member 22 may have a height $h_1$ that extends from the bottom surface 36 of the base portion 34 to the upper skin contacting surface 32. In certain embodiments, $h_1$ may be about 0.5 mm, 1 mm, or 1.5 mm to about 2 mm, 2.5 mm, or 3 mm. The width $w_1$ of the elongated skin contacting member 22 may extend from one of the lateral end portion 92 to the other lateral end portion 94. In certain embodiments, $w_1$ may be greater than $h_1$, for example, $w_1$ may be about 30%, 40%, or 50% to about 60%, 70%, or 80% greater than $h_1$. The lower profile of the elongated skin contacting member 22 (e.g., $w_1$ is greater than or equal to $h_1$) provides several advantages. First, the elongated skin contacting member 22 allows for a cartridge with a much smaller profile in which at least a portion of the blades can be positioned directly below and/or generally parallel to the elongated skin contacting member 22. In certain embodiments, a portion of the elongated skin contacting member 22 may overlap one or more of the blades 20 (as shown in FIG. 3B). Typical elongated skin contacting members (which are not glued to the cartridge) have a much larger profile that extends significantly into the cartridge housing. This configuration prevents the blades from being positioned directly below the elongated skin contacting member 22 and requires the blades to be laterally spaced apart from the seat surface, thus increasing the depth and/or width of the cartridge and may also increase the cost of manufacturing. Many consumers prefer a smaller cartridge because larger cartridges make it more difficult to shave around smaller areas, such as the nose, mouth and regions of the neck. Another possible advantage of the elongated skin contacting member 22 having a lower profile is less material is needed to manufacture the elongated skin contacting member 22, thus providing a cost savings. Also, a larger percentage of the material used to manufacture the elongated skin contacting member 22 may be located at the upper skin contacting surface 32 where it provides a skin benefit to the user.

Figure 5:
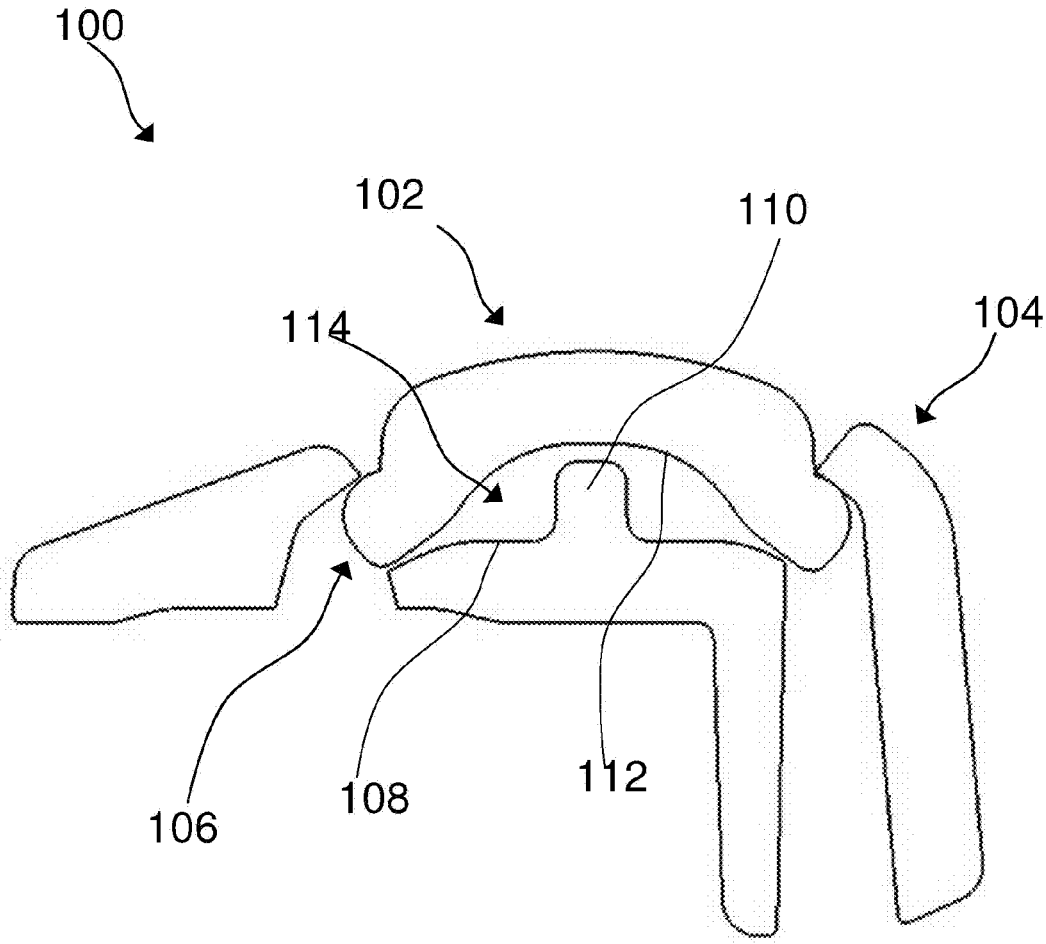
FIG. 5 is a cross section view of another possible embodiment of a cartridge, which may be incorporated into the shaving razor of FIG. 1.

Referring to FIG. 5, a cross section view of another possible embodiment of a cartridge 100 is shown. The cartridge 100 may include an elongated skin contacting member 102 secured at least partially within a pocket 106 of a housing 104. The housing 104 and the elongated skin contacting member 102 may be similar to the embodiments described above, except the housing 104 may have a seat surface 108 with a protrusion 110. The protrusion 110 may provide support for the elongated skin contacting member 102 as the elongated skin contacting member 102 is secured within the pocket 106 of the housing 104 during assembly. The elongated skin contacting member 102 may have a generally concave bottom surface 112 that is spaced apart from the seat 108 and the protrusion 110. In certain embodiments, the protrusion 110 may contact the bottom surface 112 to provide additional support for the elongated skin contacting member 102 either during shaving or assembly. For example, during assembly or during shaving downward forces may be applied to the elongated skin contacting member 102, which may cause the elongated skin contacting member 102 to deform or fracture. The protrusion 110 may support the elongated skin contacting member 102 and prevent or minimize deformation or fracture, while still allowing for a gap or open area 114 for the elongated skin contacting member 102 to swell and expand. The protrusion 110 may extend generally the length of the pocket 106 to maximize support of the elongated skin contacting member 102. The support provided by the protrusion 110 may allow the elongated skin contacting member 102 to have a smaller and more uniform wall thickness, which significantly reduces material and manufacturing costs. The support provided by the protrusion 110 may also allow for the use of weaker materials (i.e., the shaving aid composites) to manufacture the elongated skin contacting member 102.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm". In an effort to avoid any ambiguity, for the purposes of this disclosure, the term "portion" shall be construed as meaning less than 50%. For example, the term "distal end portion" should be interpreted as from about 0%, 5%, 10%, or 15% to about 15%, 20%, 25%, 30%, 40% or 45% from the terminal end of the element referenced. Similarly, the term "proximal end portion" should be interpreted as from about 0%, 5%, 10%, or 15% to about 15%, 20%, 25%, 30%, 40% or 45% from the end opposite the terminal end of the element referenced.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor cartridge comprising:

a housing including a front wall and a rear wall which together define a pocket having a seat surface, wherein at least one of the front and rear walls include one or more flexible segments;

one or more blades positioned below the seat surface;

an elongated skin contacting member that comprises a shaving aid composite that has one or more water-leachable shaving aid materials, the elongated skin contacting member having a body portion with an upper skin contacting surface and a base portion disposed at least partially within the pocket, the base portion having a bottom surface spaced apart from the seat surface, wherein the flexible segments deflect from an original position to a second position to accommodate swelling of the elongated skin contacting member due to absorption of water.

2. The shaving cartridge of claim 1 wherein the one or more flexible segments overlap the base portion.

3. The shaving cartridge of claim 1 wherein the front wall and the rear wall overlap the base portion.

4. The shaving cartridge of claim 1 wherein the one or more flexible segments are positioned along the rear wall.

5. The shaving cartridge of claim 1 wherein the one or more flexible segments are positioned along the front wall.

6. The shaving cartridge of claim 1 wherein the one or more flexible segments are positioned along both the rear wall and the front wall.

7. The shaving cartridge of claim 1 wherein the bottom surface has a generally concave profile.

8. The shaving cartridge of claim 1 wherein the housing has a proximal end portion and a distal end portion, and the pocket is at the distal end portion.

9. The shaving cartridge of claim 1 wherein the housing has a protrusion disposed within the pocket for supporting the skin contacting member.

10. A shaving razor cartridge comprising:

a housing having a pocket defined by a front wall and a rear wall, the pocket having a bottom surface forming a seat surface;

one or more blades mounted within the housing;

an elongated skin contacting member having a width and a height, the elongated skin contacting member including a body portion with an upper skin contacting surface and a base portion disposed at least partially within the pocket, the base portion having a pair of lateral end portions that contact the seat surface and are in mechanical engagement with at least one of the front wall and the rear wall to secure the elongated skin contacting member to the housing, wherein the width of the elongated skin contacting member is greater than the height of the elongated skin contacting member and the base portion has a bottom surface spaced apart from the seat surface.

11. The shaving cartridge of claim 10 wherein the skin contacting member comprises a shaving aid composite with one or more water-leachable shaving aid materials.

12. The shaving cartridge of claim 10 wherein the bottom surface has a generally concave profile.

13. The shaving cartridge of claim 10 wherein the one or more blades are positioned below the pocket.

14. The shaving cartridge of claim 10 wherein at least one of the front and rear walls include spaced apart segments.

15. The shaving cartridge of claim 14 wherein the segments include one or more flexible segments and one or more retention segments.

16. The shaving cartridge of claim 15 wherein the one or more flexible segments deflect to overlap and engage the base portion to secure the skin contacting member to the housing.

17. The shaving cartridge of claim 16 wherein an audible feedback results when the flexible segments engage the base portion.

18. The shaving cartridge of claim 17 wherein the bottom surface has a generally concave profile.

* * * * *